United States Patent [19]

Italici

[11] Patent Number: 4,854,732

[45] Date of Patent: Aug. 8, 1989

[54] UNSINKABLE BAG PROVIDED WITH FLOTATION ELEMENTS IN THE HANDLES AND BAG COMPARTMENTS

[75] Inventor: Rino Italici, San Lazzaro di Savena, Italy

[73] Assignee: Lucas International S.R.L., Granarolo dell'Emilia, Italy

[21] Appl. No.: 108,953

[22] Filed: Oct. 16, 1987

[30] Foreign Application Priority Data

Dec. 5, 1986 [IT] Italy ..... 15297/86[U]

[51] Int. Cl.[4] ..... A45C 3/10; A45C 11/22; A45C 13/26

[52] U.S. Cl. ..... 383/6; 383/38; 150/107; 206/523; 190/115

[58] Field of Search ..... 441/125, 136; 383/3, 383/4, 6, 14, 38; 190/1, 2, 102, 115; 150/107, 109; 206/522, 523; 224/264; 16/110 R

[56] References Cited

U.S. PATENT DOCUMENTS

| | | | |
|---|---|---|---|
| 398,529 | 2/1889 | Moore | 441/136 X |
| 1,744,719 | 1/1930 | Berry et al. | 383/3 |
| 1,755,548 | 4/1930 | Lowe | 383/14 X |
| 2,366,741 | 1/1945 | Manson et al. | 206/522 X |
| 2,658,543 | 11/1953 | Budnick | 383/3 X |
| 3,587,794 | 6/1971 | Mattel | 383/3 X |
| 4,044,867 | 8/1977 | Fisher | 383/3 X |
| 4,099,656 | 7/1978 | Neumann et al. | 383/3 X |
| 4,157,134 | 6/1979 | Stoll | 190/1 |
| 4,164,970 | 8/1979 | Jordan | 383/3 |
| 4,384,602 | 5/1983 | Ores | 383/3 X |

FOREIGN PATENT DOCUMENTS

| | | | |
|---|---|---|---|
| 2754061 | 6/1979 | Fed. Rep. of Germany | 206/522 |
| 2838202 | 3/1980 | Fed. Rep. of Germany | 383/3 |

*Primary Examiner*—Sue A. Weaver
*Attorney, Agent, or Firm*—Larson & Taylor

[57] ABSTRACT

A bag or sack made of a non-rigid waterproof material is rendered unsinkable by the presence of floatation inserts. Should the bag fall into the water, it does not sink and may be recovered together with its contents. The floatation inserts are inserted inside longitudinal auxiliary pockets provided at the top wall of the bag in the space between the two handles. The handles are also preferably provided with floatation elements, so as to render the gripping of the bag which has fallen into the water easier.

2 Claims, 2 Drawing Sheets

UNSINKABLE BAG PROVIDED WITH FLOTATION ELEMENTS IN THE HANDLES AND BAG COMPARTMENTS

SUMMARY OF THE INVENTION

The present invention relates to a bag or sack of the nonrigid type made of waterproof material, for example, of oilskin fabric such as that being used usually for manufacturing waterproof overall suits for water sporting activities, and which is characterized in that it is insubmersible due to the presence of flotation inserts therein. Should said bag fall into the water, it will not sink and, therefore, it may be recovered together with its contents.

According to a first feature of the invention, the floatation inserts are inserted inside longitudinal auxiliary pockets provided at the top wall of the bag. Preferably the said auxiliary pockets containing the floatation inserts are located in the space defined between the two handles.

According to a further feature of the invention, also the handles are provided with floatation elements, so as to render more easy the gripping of the bag which has fallen into the water.

BRIEF DESCRIPTION OF THE DRAWINGS

The features of said bag and the advantages resulting therefrom will be apparent from the following description, made with reference to the figures of the accompanying two sheets of drawings, in which.

DESCRIPTION OF THE PREFERRED EMBODIMENT

Figure 2:
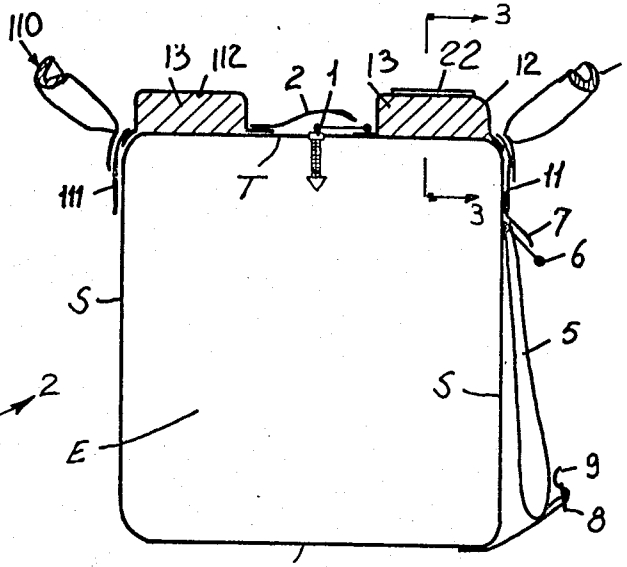
FIG. 2 is a cross-sectional view of the bag, on the line 2—2 of FIG. 1.
Figure 1:
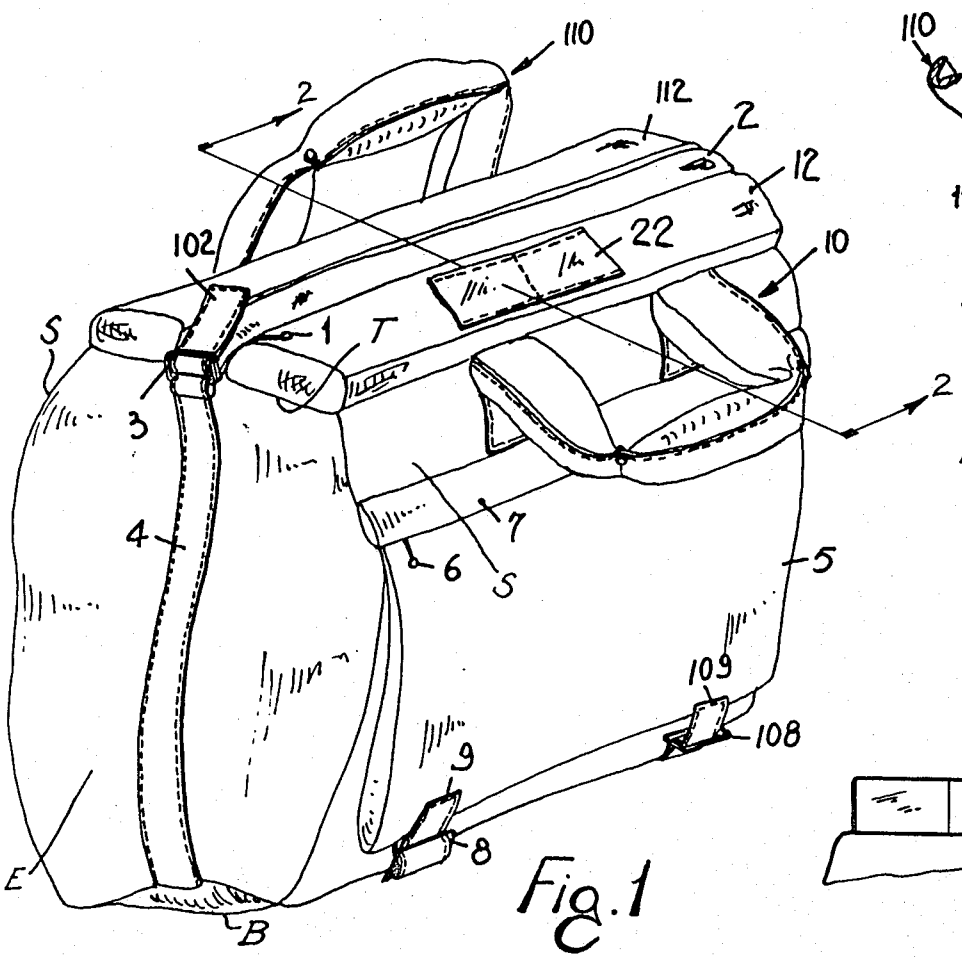
FIG. 1 is a perspective view of the bag.

With reference to FIGS. 1 and 2, it will be appreciated that the bag or sack of the invention is made of nonrigid waterproof material, preferably of oilskin fabric such as that being used usually for manufacturing waterproof overall suits for water sporting activities. The bag includes a bottom wall B, two opposed sidewalls S, two opposed end walls E and a top wall wall T.

In this example, the bag comprises a longitudinal slide fastener 1 at the centerline of its top wall, and said slide fastener is concealed by a flap 2 which is provided with end extensions 102 so as to project from the body of said bag to be anchored to buckles 3 which are secured to the top ends of vertical reinforcing straps 4 fixed to the vertical end walls E of the bag at the centerline thereof.

The bag may be provided, on one or both side walls S thereof, with an envelope or pocket 5 the top side of which is fixed to said bag and is closed by a slide fastener 6 which is concealed by a flap 7. The bottom side of said pocket 5 is provided, at symmetrical positions, with external buckles, 8,108 similar to buckle 3 and designed to be anchored to small straps 9,109 fixed to the bottom wall of the bag. The numerals 10,110 designate the handles secured symmetrically at the center region of reinforcing bands 11,111 which are, in turn, secured longitudinally on the upper region of the side walls of said bag.

Figure 3:
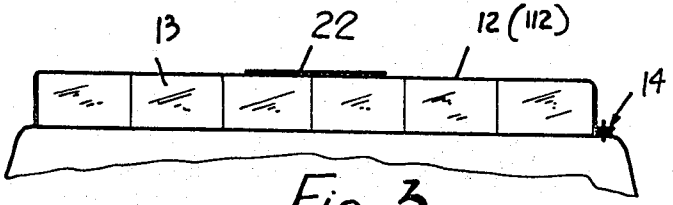
FIG. 3 is an axial sectional view on the line 3—3 of FIG. 2, showing further constructional details of the bag.

The characterizing feature of the bag according to the invention resides in the fact that, preferably at the top wall of the bag, between the bands 11,111 and at the longitudinal sides of sides of said slide fastener 1, there are provided longitudinal auxiliary pockets 12,112 which may be opened, for example, at one end thereof, and into which there may be inserted floatation bodies 13, such as blocks of foamed polystyrene, preferably in a removable manner. Thereafter, said pockets 12,112 may be closed by suitable means 14 arranged at their opened ends and comprising, for example, strips made of material having adhesive properties, e.g., of the type known on the market under the registered trademark "VELCRO", buttons, or the like (see also FIG. 3).

Due to the presence of the floatation inserts 13, the bag is made insubmersible (unsinkable) and, if it should fall into the water it may be recovered easily with it contents.

For aesthetical reasons, said pockets 12,112 are visible, but it is to be understood that they might be concealed inside the bag.

It is also to be understood that, in combination or as an alternative to what set forth above, supplementary pockets intended to contain floatation inserts may be provided on the vertical end walls E or on the bottom wall B of the bag, or entirely or partly on the side walls S of said bag.

The auxiliary pockets 12 and 112, when the bag is not being used for excursions on the water, may be deprived of the inserts 13 and may be used for containing any other object.

On at least one of said pockets 12,112 there may be fixed, at an intermediate position, a composite transparent pocket 22 (FIG. 1) adapted to contain one or more tags with inscriptions exposed to the view.

With reference to FIGS. 4 to 7, one of the handles 10,110 of the bag will be described in detail.

Figure 5:
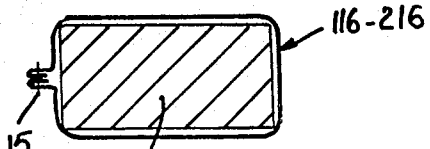
FIGS. 5. 6 and 7 are sectional views on the section 5—5, 6—6 and 7—7, respectively, of FIG. 4, showing further constructional details of the handle.

Said handle is formed by a tubular casing made of the same material forming the bag, obtained from a rectangular strip of said material which is formed into a tubular shape by means of a longitudinal seam 15 (FIG. 5). The handle is assembled in place so that said seam 15 will be facing outwards.

The end portions 16,116 of the handle are adapted to receive floatation inserts 17 of foamed polystyrene to increase the floating capacity of the bag and to facilitate the gripping the handle should the bag fall into the water.

Figure 6:
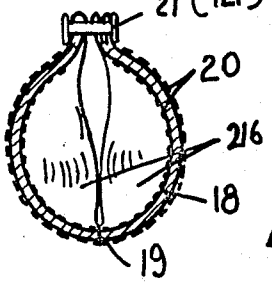
Figure 7:
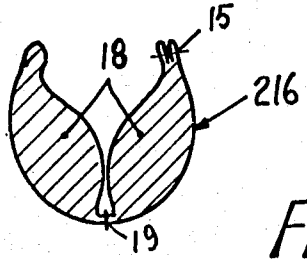
Figure 4:
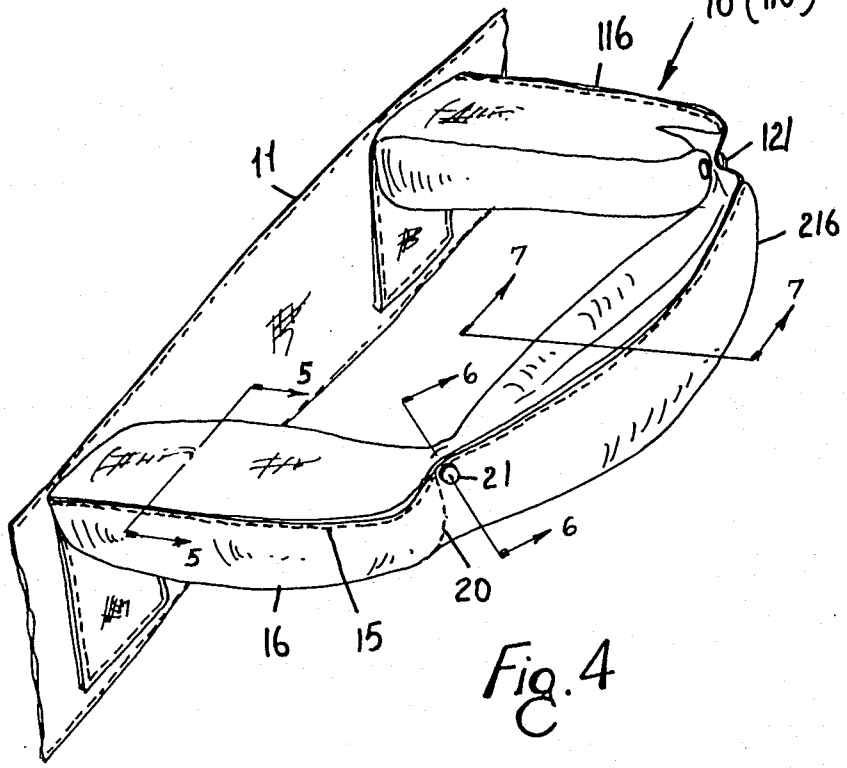
FIG. 4 is an enlarged perspective view of one of the handles of the bag.

The intermediate portion of the handle, indicated at 216 and intended to be gripped, is stuffed with foamed rubber 18 and is provided with a longitudinal central seam 19 and with two transverse end seams 20, whereafter this handle portion is folded with its superposed edges directed towards the opposite handle. The handle portion 216 is held in said folded over condition by means of two end rivets 21,121 (FIG. 6).

The intermediate portion of the handles 10-110, therefore, is of considerable thickness and softness. The edges of said portion 216 of the handles are facing towards each other when said handles are approached to transport the bag, whereby said edges and seams 15 are not felt by the user's hand.

I claim:

1. A bag made of waterproof fabric, of the type comprising a bottom wall (B), two opposed sidewalls (S), two opposed end walls (E), a longitudinal top wall (T), a pair of handles (10,110) oriented in the longitudinal direction of the top wall (T) and respectively secured in proximity of a respective intersection between the top wall and the respective sidewalls, each handle (10,110) including two end portions (16,116), and intermediate portion (216) serving as a grip, and suitable floatation elements (17) provided in the said end portions (16,116), a bag closure means (1) extending longitudinally along a centerline of the top wall (T), a pair of auxiliary pockets (12,112) provided in the top wall (T) and extending longitudinally between a respective handle (10,110) and the closure means (1), and a floatation insert (13) provided in each respective auxiliary pocket to render the bag unsinkable.

2. A bag according to claim 1, in which each handle (10,110) is formed by a tubular casing made of the same material forming the bag; in which the intermediate portion serving as a grip (216) is provided with a longitudinal central seam (19) and with transverse end seams (20), and is stuffed with foamed rubber (18) which is folded over so that the overlapped edges will be directed towards the other handle; and in which end rivets (21,121) hold the intermediate portions in said folded over condition.

* * * * *